US012305379B2

(12) United States Patent
Rübesamen et al.

(10) Patent No.: US 12,305,379 B2
(45) Date of Patent: May 20, 2025

(54) FASTENING DEVICE FOR A SANITARY COMPONENT TO BE SUSPENDED

(71) Applicant: Grohe AG, Hemer (DE)

(72) Inventors: Paul Rübesamen, Meschede (DE); Hendrik Begerow, Hemer (DE); Stephan Venus, Menden (DE); Franziska Kalka, Soest (DE); Pei Guo, Herzogenrath (DE); Bertrand Tchana Tchuinou, Hagen (DE); Hendrik Heitkamp, Dortmund (DE)

(73) Assignee: GROHE AG, Hemer (DE)

( * ) Notice: Subject to any disclaimer, the term of this patent is extended or adjusted under 35 U.S.C. 154(b) by 234 days.

(21) Appl. No.: 17/912,721

(22) PCT Filed: Feb. 23, 2021

(86) PCT No.: PCT/EP2021/054382
§ 371 (c)(1),
(2) Date: Feb. 3, 2023

(87) PCT Pub. No.: WO2021/185535
PCT Pub. Date: Sep. 23, 2021

(65) Prior Publication Data

US 2023/0235544 A1 Jul. 27, 2023

(30) Foreign Application Priority Data

Mar. 19, 2020 (DE) ..... 102020107563.4

(51) Int. Cl.
*E03D 11/14* (2006.01)

(52) U.S. Cl.
CPC ..... *E03D 11/14* (2013.01)

(58) Field of Classification Search
CPC ..... E03C 1/322; E03D 11/14
USPC ..... 4/252.2
See application file for complete search history.

(56) References Cited

U.S. PATENT DOCUMENTS

2012/0186008 A1* 7/2012 Sneve ..... A47K 13/26 4/252.2

FOREIGN PATENT DOCUMENTS

| | | | |
|---|---|---|---|
| EP | 2 857 604 | 4/2015 | |
| WO | 2010/143965 | 12/2010 | |
| WO | 2013/167186 | 11/2013 | |
| WO | WO-2013167186 A1 * | 11/2013 | ..... E03C 1/322 |

OTHER PUBLICATIONS

Translation of WO2013167186 (Year: 2013).*
International Search Report issued Jul. 14, 2021, in International (PCT) Application No. PCT/EP2021/054382, with English translation.

* cited by examiner

*Primary Examiner* — Lauren A Crane
(74) *Attorney, Agent, or Firm* — Wenderoth, Lind & Ponack, L.L.P.

(57) ABSTRACT

A fastening device (1) for a sanitary component (2) to be suspended having at least one adapter pin (3) adapted to hold or comprise a retaining bolt (5) at a first end (4) for the sanitary component (2) and further having at a second end (6) a widened retaining cam (7), and at least one rotatable cam holder (8) adapted to hold and lock the retaining cam (7) of the adapter pin (3). Furthermore, a method and a use of such a fastening device (1) for the permanent and positionally accurate suspension of a ceramic sanitary component (2) on a wall are proposed.

16 Claims, 3 Drawing Sheets

FASTENING DEVICE FOR A SANITARY COMPONENT TO BE SUSPENDED

The present invention relates to a fastening device for a sanitary component to be suspended, in particular for a toilet bowl to be suspended from a wall.

For mounting toilets, it has been necessary to operate fastening systems under difficult and ergonomically unfavorable conditions. For instance, the plumber has to crawl at least partially under a toilet bowl. Furthermore, usually systems are used for mounting whose pre-mounting or initial fastening is sometimes very fragile, resulting in them breaking during final assembly and the assembly set can therefore no longer be used as intended. An example of this is a system in which bolt elements are not bolted into the ceramic or toilet bowl, but the latter is merely clamped against the sanitary installation element as with a flange (bolt connection). This system encompasses significantly more components than a conventional bolt connection to apply the clamping force required for such applications at an angle of 90° instead of axially. Furthermore, such a system is used to pre-fasten the toilet on the stud bolts of the sanitary installation element.

Based thereon, this invention addresses the problem of at least partially solving the problems indicated with reference to the prior art. In particular, a fastening device for a suspended sanitary component is to be proposed, in particular a toilet bowl, which makes for convenient, fast and/or secure fastening of the sanitary component to a retaining bolt interacting with a wall.

These problems are solved by a fastening device and a method for mounting a suspended sanitary component on a wall according to the independent claims. It will be appreciated that the features listed individually in the dependent claims may be combined in any technologically useful manner and define further embodiments of the invention. In addition, the features indicated in the claims are further specified and explained in the description, wherein further preferred embodiments of the invention are illustrated.

A fastening device for a sanitary component to be suspended, which comprises at least the two components listed below, contributes to solving this problem:

- at least one adapter pin designed to hold or comprise a retaining bolt for the sanitary component at a first end and further having an enlarged retaining cam at a second end; and
- at least one rotatable cam holder adapted to hold and lock the retaining cam of the adapter pin.

In particular, the fastening device proposed herein is a set of two separate components, namely the at least one adapter pin and the at least one cam holder. Typically, the fastening device for exactly one single retaining bolt also comprises exactly one single adapter pin and one single cam holder. In this case, the adapter pin and/or cam holder are designed to withstand the mounting forces and/or the forces that occur during the use of the sanitary component.

The adapter pin is preferably an elongated component having a peripheral surface and two opposite ends. It is preferred that one of the ends, referred to herein as the first end, is configured to hold or comprise the retaining bolt for the sanitary component. If the adapter pin comprises the retaining bolt, an integral embodiment may be selected. Quite preferably, the adapter pin comprises a mount for the retaining bolt at this first end, in particular starting from a front end at this first end, such that this end section of the adapter pin can at least partially enclose or surround the retaining bolt. The retaining bolt can, for instance, be screwed onto or into the adapter pin. A thread may advantageously be provided for this purpose. Preferably, the retaining bolt is held in the first end of the adapter pin such that the retaining bolt and adapter pin are interaligned along a direction referred to here as the mounting axis. Thus, the adapter pin can be considered as a kind of extension for the retaining bolt when mounted.

The adapter pin can then be tapered after the mounting area for the retaining bolt, i.e. at a certain distance from the first end, and then widen again towards the second end. In particular, provision is made for a widened retaining cam to be provided at the second end. The retaining cam may be a disc-shaped pin head that is equally widened in the circumferential direction of the adapter pin. However, this is not absolutely necessary. In particular, the widened retaining cam forms an undercut as viewed from the second end of the adapter pin. This undercut is particularly designed to interact with the rotatable cam holder.

The cam holder is accordingly designed to hold and lock the retaining cam of the adapter pin. In other words, this means in particular that the cam holder forms a cavity or the like into which the retaining cam of the adapter pin can be inserted. Preferably, the cam holder is designed such that the retaining cam of the adapter pin can only enter this cavity in a precisely predeterminable relative position of adapter pin and cam holder. The cam holder is designed to be rotatable, wherein the axis of rotation of the cam holder is aligned, in particular perpendicular, to the mounting axis of the adapter pin. In particular, the adapter pin can be initially partially inserted into the cam holder in a predetermined position and held there, and then a rotational motion prevents any outward motion of the adapter pin from the cam holder. This is preferably prevented by a form fit. In particular, the adapter pin is considered "locked" when it can no longer be removed from the cam holder along the mounting axis (using a solely translational motion).

In this it is particularly preferred that the at least one adapter pin and the at least one cam holder are made of metal or a material equivalent in terms of mechanical properties. Thus, the adapter pin and cam holder are designed precisely for the loads that can occur with a sanitary component to be suspended, in particular a toilet bowl.

It is further preferred that the at least one adapter pin and the at least one cam holder form a bayonet connection. In particular, this means that the adapter pin can first be inserted into the cam holder in a predetermined relative position to the cam holder, and then a rotation of the cam holder produces a form fit and/or a frictional fit that prevents the adapter pin from moving back out of the cam holder. For this purpose, the cam holder can have a contour inside, which is used to lock the adapter pin, in particular the widened retaining cam. It is also possible to design the bayonet connection such that the widened retaining cam takes an exact relative position inside the cam holder. Accordingly, the bayonet connection can also be used in particular to clamp the sanitary component relative to the wall, in that when the cam holder is turned, the widened retaining cam moves further into the inner area of the cam holder and in that way the sanitary component is moved closer to the wall via the retaining bolt. In particular, this bayonet connection is a mechanical connection between the adapter pin and the cam holder that can be opened and closed repeatedly.

It is further proposed that the at least one adapter pin and the at least one cam holder are held in at least one mounting sleeve having a mounting axis such that the at least one adapter pin can be inserted along the mounting axis and the at least one cam holder can be rotated about the axis of rotation perpendicular to the mounting axis.

A mounting sleeve is preferably configured to fully or nearly fully hold the at least one adapter pin and the at least one cam holder. In particular, the mounting sleeve extends approximately in parallel or coaxially to the adapter pin. The mounting sleeve can be designed to be open at the two end areas, for instance via a drilled hole. Again, the mounting sleeve has a first end, through which the adapter pin can be inserted (in conjunction with the retaining bolt, if applicable). The cam holder is positioned away from this first end, i.e. in particular closer to the second opposite end. It is possible to insert the cam holder radially into the mounting sleeve, wherein re-emergence from the mounting sleeve is implemented solely by a form fit with the adapter pin, if necessary. If necessary, the cam holder can protrude radially beyond the circumferential surface of the mounting sleeve, for instance to implement a convenient connection for tools to perform the rotation. Consequently, the mounting sleeve may be provided with a radial aperture through which the cam holder can be inserted into internal areas of the mounting sleeve. The mounting sleeve can be designed to be integrally formed or can be of multi-part design, for instance consisting of 2, 3, 4 or 5 (sleeve-like, possibly screwable) parts. With a multi-part mounting sleeve, a distance can be set correctly or bridged flexibly.

It is further preferred that the at least one mounting sleeve is configured to be bipartite, wherein a first mounting sleeve part can at least be partially held and locked in a second mounting sleeve part. In particular, the adapter pin can be in contact with (only) the first mounting sleeve part (directly), and the cam holder can be in contact with (only) the second mounting sleeve part (directly). Providing a bipartite mounting sleeve permits the relative position of the first mounting sleeve part and the mounting sleeve part to be adjustable with respect to each other. This can be used, for instance, to adjust the relative position of the adapter pin and cam holder for a pre-assembly position. In particular, the mounting sleeve parts can in conjunction form a threaded section, which can be used to precisely adjust and lock this relative position.

The mounting sleeve or the mounting sleeve parts are preferably made entirely of plastic.

It is further proposed that the first mounting sleeve part and the second mounting sleeve part each have a clamping collar projecting outwards. The clamping collar is preferably circumferential. In particular, the two opposing clamping collars are used to secure a component projecting between the clamping collars or to secure the mounting sleeve there with a precise fit. In particular, the clamping collars are used to interact with the sanitary component to quickly and easily fasten the mounting sleeve in or to the sanitary component. Preferably, both clamping collars are arranged at the front ends of the first mounting sleeve part and on the second mounting sleeve part.

It is further proposed for at least the at least one cam holder to comprise at least one snap lug that can be brought into operative engagement with the at least one mounting sleeve, such that an opening motion of the cam holder is at least hindered. In particular, the at least one snap lug is formed using metal, while the mounting sleeve is made of plastic.

The cam holder may have a plurality of rib-like snap lugs on its peripheral surface, which interact with, for instance, the material adjacent the aperture in the mounting sleeve when the overall assembly is clamped or the toilet bowl is firmly secured to the wall. The snap lugs are then used (possibly only in the clamped situation) in particular to increase the friction with respect to the mounting sleeve. Alternatively or additionally, it is possible to provide a counter contour close to the mounting sleeve, wherein a snap lug provided at the bottom of the cam holder interacts with this counter contour. This also hinders the resistance to opening the cam holder, i.e. turning back the cam holder. The design of the snap lug(s) is preferably such that an undesired opening motion, for instance during subsequent operation of the sanitary device, is prevented.

According to a further aspect, a sanitary component is proposed, in particular a toilet bowl, comprising at least one passage for a retaining bolt and at least one further orifice towards the passage, wherein at least one fastening device of the type described herein can be arranged in the passage such that the at least one cam holder can be rotated via the orifice. The sanitary component may be formed of ceramic, mineral casting, metal, plastic or similar materials.

In particular, the sanitary component is configured such that in the rear portion of the sanitary component the passage is mainly perpendicular to the wall. It is further preferred that the orifice extends from an upper surface (in the assembled state) of the sanitary component to this passage. The arrangement of the fastening device, in particular the axis of rotation of the cam holder, is now such that the cam holder can be rotated through this orifice by means of a common tool, for instance a screwdriver, an Allen key, etc. Thus, the axis of the orifice and the axis of rotation of the cam holder are approximately parallel and coaxial to each other. With a suitable mounting situation and/or tool (e.g. Allen key with ball head), a certain deviation in the position of the axes can also be permissible; for instance, a deviation of up to about 45° in the axis position can still be compensated if necessary, regardless of whether the system is at an angle or the angle results from misalignment.

Quite preferably, the orifice is set up for securing a functional component. For instance, the orifice may be provided for securing another sanitary device, a fitting, a closure element, a lid, etc. In particular, in this way additional passages solely for the operation of the fastening device can be avoided.

According to a further aspect, the use of a fastening device of the type described herein for the permanent and positionally accurate suspension of a ceramic sanitary component from a wall is proposed. The ceramic sanitary component is preferably a toilet bowl, bidet, or the like. In particular, the use permits mounting (only) from one direction, i.e. in particular (only) from above or (only) from below, for the plumber to find an ergonomically simple working situation.

According to yet a further aspect, a method of mounting a suspended sanitary component on a wall by means of a fastening device, in particular a fastening device as previously described herein, is explained. The mounting method comprises at least the steps outlined below:

a) clamping an (at least) bipartite mounting sleeve at a shoulder of the sanitary component in the vicinity of a passage of the sanitary component for a retaining bolt to be secured to the wall,
b) connecting an adapter pin to the retaining bolt if they are separate components,
c) inserting the adapter pin into the mounting sleeve,
d) locking a widened retaining cam of the adapter pin using a rotatable cam holder arranged in the mounting sleeve.

The above explanations of the fastening device can also be used to characterize the mounting method described herein. In this respect, reference is made to the statements made there and we fully refer to anything written there.

The steps listed here are to be performed in approximately the specified sequence a) to d), wherein the steps may also overlap at least temporarily.

A sanitary component mounted in a suspended manner in this way has at least some of the above advantages and is therefore particularly preferable.

The clamping according to step a) is performed in particular by adjusting a relative position of the bipartite assembly sleeve with respect to each other, for instance using the clamping collars described above. Obviously, the retaining bolt does not have to be directly or immediately securable to the wall; it is also possible for the retaining bolt to be part of a mounting frame or mounting wall.

Connecting the adapter pin to the retaining bolt according to step b) comprises, in particular, screwing the retaining bolt into the adapter pin. If an integral design of adapter pin and retaining bolt is provided, step b) can also be omitted.

Preferably, in step c), the adapter pin is inserted into the mounting sleeve until its retaining cam is held inside a cam holder also provided in the mounting sleeve.

The widened retaining cam is then locked according to step d) in particular by rotating the cam holder about an axis of rotation that is perpendicular to the mounting axis. Locking is preferably releasable.

In summary, the solution described here permits, in particular, the clever use of the existing holes for mounting the toilet seats. In particular, the toilet bowl can be pulled up against the wall from above, eliminating any need to crawl under the toilet.

The adapter pin can first be screwed onto the retaining bolt. Thereafter or simultaneously, the mounting sleeve can be inserted into the fastening holes or passages of the toilet. The cam holder can be inserted into the provided lateral hole or aperture of the mounting sleeve and aligned axially with the mount for the widened retaining cam of the adapter pin. By screwing the adapter pin onto the retaining bolt, the position of the adapter pin is adjusted to the correct length. The ceramic component, in particular the toilet bowl, can then be slid onto the adapter pin, wherein the adapter pin is inserted into the mounting sleeve located there, in conjunction with the cam holder positioned therein. By turning the cam holder using, for instance, a commercially available screwdriver, the cam holder applies the required clamping force to the adapter pin. Groove-like snap lugs, for instance on the circumferential surface or on the outside of the cam holder, can dig into the surface of the mounting sleeve during the clamping process, securing the cam holder against loosening.

The invention and its technical environment presented here are explained in more detail below with reference to the figures. It should be noted that the invention is not intended to be restricted by the shown exemplary embodiments. In particular, unless explicitly stated otherwise, it is also possible to extract partial aspects of the facts explained in or in the context of the Figures and combine them with other components and/or findings from other Figures and/or this description.

In an exemplary and schematic manner

Figure 1:
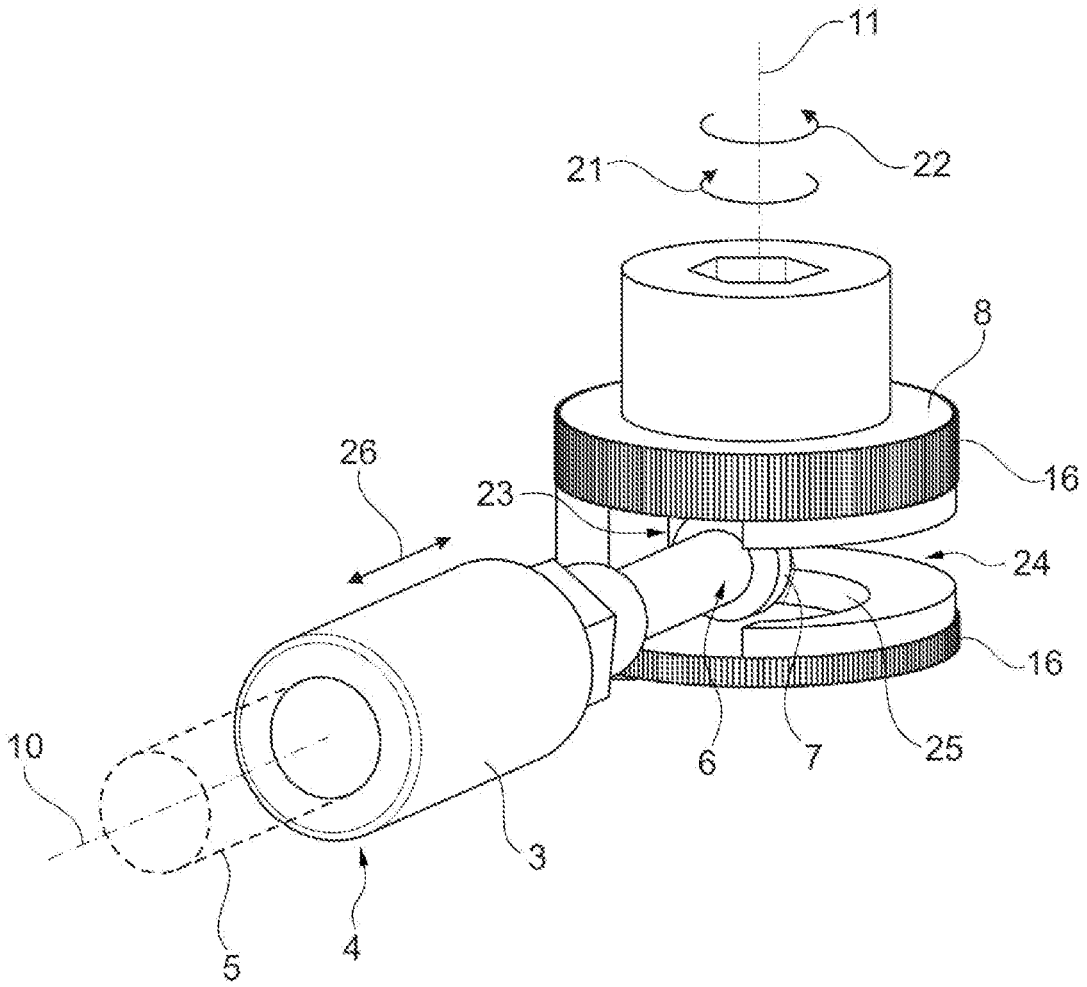
FIG. 1 shows a perspective view of a fastening device.

FIG. 1 shows a perspective view of a fastening device 1 for a sanitary component 2 to be suspended. In particular, an adapter pin 3 is shown here partially held (in a still open position) in a rotatable cam holder 8.

The adapter pin 3 is adapted to hold a retaining bolt 5 for the sanitary component at its first end 4. In particular, the adapter pin 3 is widened in the area of the first end 4 and has, for instance, a female threaded section for holding the retaining bolt 5. A widened retaining cam 7 is provided opposite at the second end 6. Since the adapter pin 3 and the retaining bolt 5 are used in conjunction to arrange the sanitary component 2 on a wall, they are designed to be coaxial to a mounting axis 10. Clamping or fastening is thus performed along the fastening motion 26, which is parallel to the mounting axis 10.

A rotatable cam holder 8 holds the second end 6, in particular having the widened retaining cam 7 of the adapter pin 3. The cam holder 8 can be rotated about an axis of rotation 11 oriented perpendicular to the mounting axis 10. One direction of rotation causes a locking motion 21, the opposite direction of rotation causes an opening motion 22 of the cam holder 8. In a section or centrally to the axis of rotation 11, the cam holder 8 is provided with a tool port, for instance for holding an Allen key.

The cam holder 8 is also provided with a recess 23, through which the second end 6 of the adapter pin 3 can be inserted laterally into the cam holder 8 together with the retaining cam 7. A gap 24 is formed adjacent to this recess 23, such that during a locking motion 21 this gap comprises the widened retaining cam 7 and, in that way, locks it in place. The gap 24 preferably extends (only) partially in the circumferential direction of the cam holder 8 and is then delimited by a stop. A contour 25 can also be provided on the inside, such that a fastening motion 26 is performed simultaneously with the locking motion 21 or opening motion 22.

Further, the cam holder 8 is designed having groove-like snap lugs 16 on the outer surface. These can be used to interact with adjacent components, particularly a mounting sleeve, when the fastening device is in the clamped state.

Figure 2:
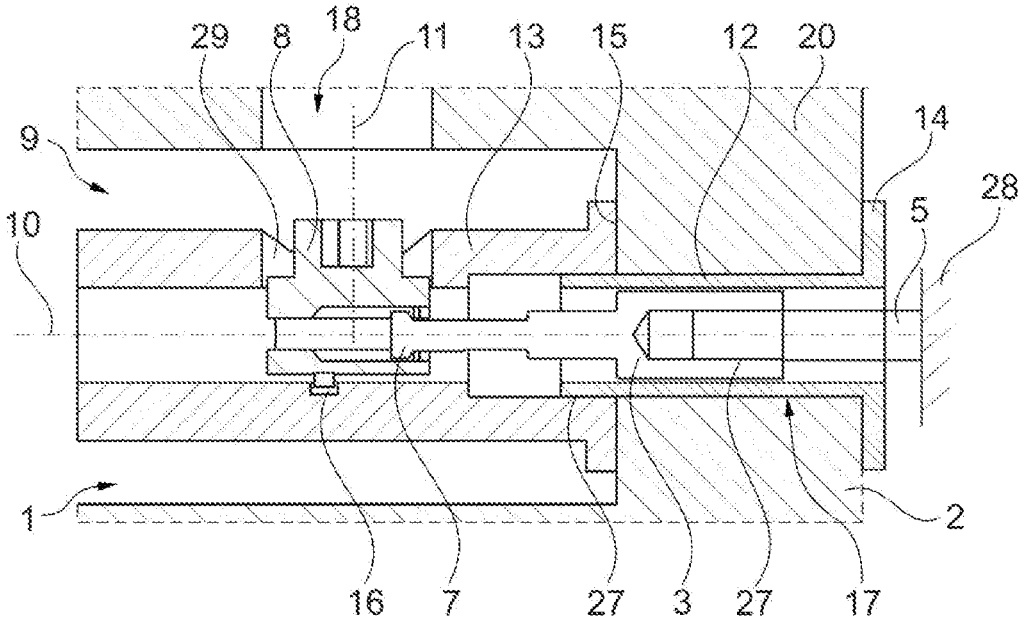
FIG. 2 shows a mounted fastening device in a suspended sanitary component.

FIG. 2 shows a fastening device 1 integrated in a sanitary component 2. The sanitary component 2 has a shoulder 20, in which a passage 17 is provided. A retaining bolt 5 to be fastened to a wall 28 extends at least partially through this passage 17, by means of which securing bolt the sanitary component 2 is to be clamped against the wall 28.

A thread 27 is used to screw an adapter pin 3 onto this retaining bolt 5, such that they are interaligned along the mounting axis 10. The adapter pin 3, with a widened retaining cam 7, is arranged at the other end opposite from the thread 27.

A bipartite mounting sleeve 9 is provided in the passage 17 of the sanitary component 2, wherein the mounting sleeve 9 has a first mounting sleeve part 12 and a second mounting sleeve part 13. The first mounting sleeve part 12 has a male thread 27 at the (left) end, with which it is secured to the second mounting sleeve part 13. A first clamping collar 14 is provided at the opposite (right) end of the first mounting sleeve part 12. The second mounting sleeve 13 also has a second clamping collar 15 in the area of the thread 27. The thread 27 between the first mounting sleeve part 12 and the second mounting sleeve part 13 can be used to adjust the relative position of the first clamping collar 14 and the second clamping collar 15 to clamp the two clamping collars 14, 15 to the shoulder 20 of the sanitary component 2. This enables rough pre-assembly of the mounting sleeve 9 in the sanitary component 2.

The cam holder 8 is inserted into a lateral or radial aperture 29 of the second mounting sleeve part 13. In so doing, the arrangement is preferably such that an axis of rotation 11 of the cam holder 8 passes through a further orifice 18 of the sanitary component 2. A snap lug 16 can be provided opposite or on the underside of the cam holder 8, which permits it to be locked or centered there. When the sanitary component 2 with integrated mounting sleeve 9 and cam holder 8 is slipped over the adapter pin 3 including the retaining bolt 5, the widened retaining cam 7 engages with the cam holder 8. By rotating the cam holder 8, the cam holder 8 encompasses the retaining cam 7, locking it in place and applying a tensile force. In this way, the sanitary component 2 is moved towards the wall 28 and can be clamped against it.

Figure 3:
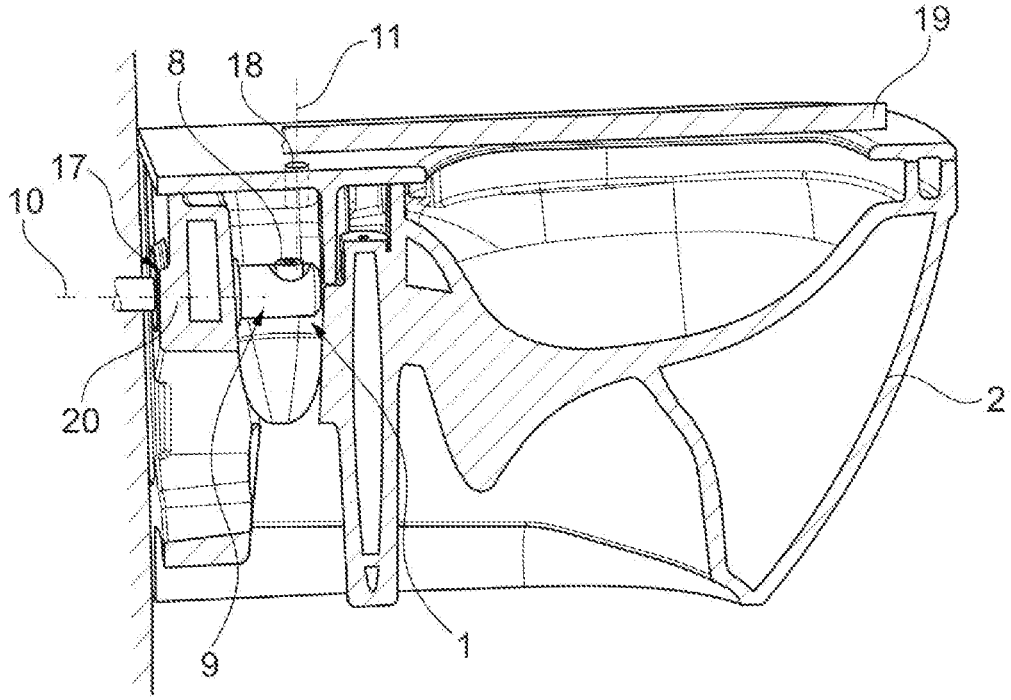
FIG. 3 shows an integration of a fastening device in a sanitary component.

FIG. 3 illustrates a section through a sanitary component 2 in the manner of a toilet bowl, wherein the relative position of the fastening device 1 to the sanitary component 2 is to be illustrated once again. A passage 17 is provided at the rear and along the mounting axis 10 for holding the retaining bolt or mounting sleeve 9. The mounting sleeve 9, which may be of bipartite design, can be pre-attached to a shoulder 20, which in particular forms the passage 17, of the sanitary component 2. The orientation of the axis of rotation 11 of the cam holder 8 is then preferably such that it can be reached or actuated through the further orifice 18. This orifice 18 can be provided, for instance, for securing another functional part 19, such as a toilet lid in this case.

Figure 4:
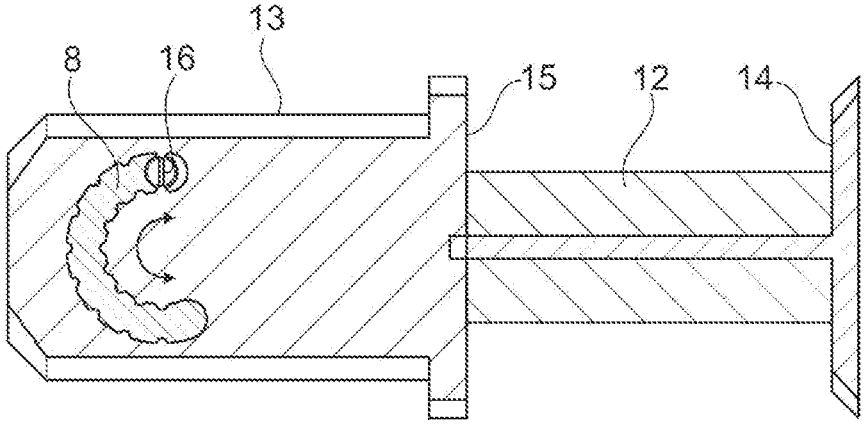
FIG. 4 shows a sectional view of a fastening device.

As indicated for FIG. 2 above, a safety device can be provided in the mounting sleeve, in particular in the second mounting sleeve part 13, which can be used to prevent an unintentional opening motion of the cam holder 8. FIG. 4 shows a partial section of the mounting sleeve, wherein a groove (in a kind of counter contour) is arranged on the inside (i.e. not visible from the outside of the mounting sleeve), which can interact with a snap lug 16. The groove has a textured contour 25 resulting in a plurality of snap positions for the snap lug 16, impeding the motion towards the open position.

In addition to the above functions, there may be another advantage: The cam holder 8 is secured against falling out by two snap caps formed in the mounting sleeve 9 when mounted with the tool holder facing downwards.

Figure 5:
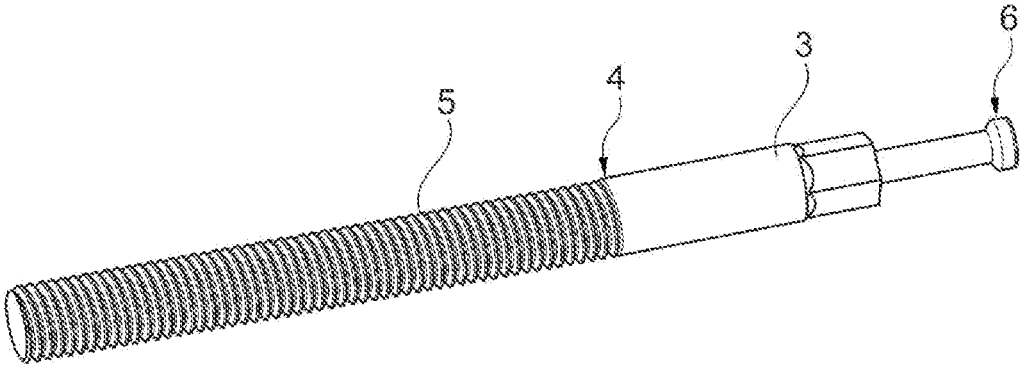
FIG. 5 shows an embodiment of an adapter pin that is made integrally with the retaining bolt.

FIG. 5 illustrates the situation where the adapter pin 3 comprises the retaining bolt 5, i.e., this is an integral embodiment. In other words, the retaining bolt 5 is molded directly onto the first end 4 of the adapter pin 3 made of the same material. In all other respects, reference is made to the above explanations.

LIST OF REFERENCE NUMERALS 1 fastening device
2 sanitary component
3 adapter pin
4 first end
5 retaining bolt
6 second end
7 retaining cam
8 cam holder
9 mounting sleeve
10 mounting axis
11 axis of rotation
12 first mounting sleeve
13 second mounting sleeve
14 first clamping collar
15 second clamping collar
16 snap lug
17 passage
18 orifice
19 functional part
20 shoulder
21 locking motion
22 opening motion
23 recess
24 gap
25 contour
26 fastening motion
27 thread
28 wall
29 aperture

The invention claimed is:

1. A fastening device (1) for a sanitary component (2) to be suspended, comprising at least one adapter pin (3) adapted to hold or comprise a retaining bolt (5) for the sanitary component (2) at a first end (4) and also has a widened retaining cam (7) at a second end (6), and at least one rotatable cam holder (8) adapted to hold and lock the retaining cam (7) of the adapter pin (3), wherein the at least one adapter pin (3) and the at least one cam holder (8) are held in at least one mounting sleeve (9) having a mounting axis (10) such that the at least one adapter pin (3) can be inserted along the mounting axis (10) and the at least one cam holder (8) can be rotated about an axis of rotation (11) perpendicular to the mounting axis (10).

2. The fastening device (1) according to claim 1, wherein the at least one adapter pin (3) and the at least one cam holder (8) are made of metal.

3. The fastening device (1) according to claim 1, wherein the at least one adapter pin (3) and the at least one cam holder (8) form a bayonet connection.

4. The fastening device (1) according to claim 1, wherein the at least one mounting sleeve (9) is designed to be bipartite, wherein a first mounting sleeve part (12) can be at least partially held and locked in a second mounting sleeve part (13).

5. The fastening device (1) according to claim 4, wherein the first mounting sleeve part (12) and the second mounting sleeve part (13) each have a clamping collar (14, 15) projecting outwards.

6. The fastening device (1) according to claim 1, wherein at least the at least one cam holder (8) comprises at least one snap lug (16) that can be brought into operative engagement with the at least one mounting sleeve (9), such that an opening motion (22) of the cam holder (8) is at least impeded.

7. A sanitary component (2), comprising at least one passage (17) for a retaining bolt (5) and at least one further orifice (18) towards the passage (17), wherein at least one fastening device (1) can be arranged in the passage (17) such that the at least one cam holder (8) can be rotated via the orifice (18), wherein the at least one fastening device (1) comprises at least one adapter pin (3) adapted to hold or comprise a retaining bolt (5) for the sanitary component (2) at a first end (4) and also has a widened retaining cam (7) at a second end (6), and at least one rotatable cam holder (8) adapted to hold and lock the retaining cam (7) of the adapter pin (3).

8. The sanitary component (2) according to claim 7, wherein the orifice (18) is arranged for securing a functional component (19).

9. The fastening device (1) according to claim 1, wherein the fastening device (1) is capable of providing a permanent and positionally accurate suspension of a sanitary component (2) on a wall.

10. A method for mounting a suspended sanitary component (2) on a wall by means of a fastening device (1), comprising the following steps:

a) clamping a bipartite mounting sleeve (9; 12, 13) to a shoulder (20) of the sanitary component (2) in the vicinity of a passage (17) of the sanitary component (2) for a retaining bolt (5) to be secured to the wall;

b) connecting an adapter pin (3) to the retaining bolt (5) if they are separate components;

c) inserting the adapter pin (3) into the mounting sleeve (9; 12, 13); and d) locking a widened retaining cam (7) of the adapter pin (3) using a rotatable cam holder (9, 12, 13) arranged in the mounting sleeve (8).

11. The sanitary component (2) according to claim 7, wherein the at least one adapter pin (3) and the at least one cam holder (8) are made of metal.

12. The sanitary component (2) according to claim 7, wherein the at least one adapter pin (3) and the at least one cam holder (8) form a bayonet connection.

13. The sanitary component (2) according to claim 7, wherein the at least one adapter pin (3) and the at least one cam holder (8) are held in at least one mounting sleeve (9) having a mounting axis (10) such that the at least one adapter pin (3) can be inserted along the mounting axis (10) and the at least one cam holder (8) can be rotated about an axis of rotation (11) perpendicular to the mounting axis (10).

14. The sanitary component (2) according to claim 13, wherein the at least one mounting sleeve (9) is designed to be bipartite, wherein a first mounting sleeve part (12) can be at least partially held and locked in a second mounting sleeve part (13).

15. The sanitary component (2) according to claim 14, wherein the first mounting sleeve part (12) and the second mounting sleeve part (13) each have a clamping collar (14, 15) projecting outwards.

16. The sanitary component (2) according to claim 13, wherein at least the at least one cam holder (8) comprises at least one snap lug (16) that can be brought into operative engagement with the at least one mounting sleeve (9), such that an opening motion (22) of the cam holder (8) is at least impeded.

* * * * *